US008974579B2

(12) United States Patent
Swoboda et al.

(10) Patent No.: US 8,974,579 B2
(45) Date of Patent: Mar. 10, 2015

(54) DEVICE FOR SEPARATING PAINT OVERSPRAY

(75) Inventors: Werner Swoboda, Boeblingen (DE); Erwin Hihn, Walddorfhaeslach (DE)

(73) Assignee: Eisenmann AG, Boeblingen (DE)

( * ) Notice: Subject to any disclaimer, the term of this patent is extended or adjusted under 35 U.S.C. 154(b) by 791 days.

(21) Appl. No.: 13/060,784

(22) PCT Filed: Aug. 22, 2009

(86) PCT No.: PCT/EP2009/006105

§ 371 (c)(1),
(2), (4) Date: Feb. 25, 2011

(87) PCT Pub. No.: WO2010/025844

PCT Pub. Date: Mar. 11, 2010

(65) Prior Publication Data

US 2011/0154988 A1 Jun. 30, 2011

(30) Foreign Application Priority Data

Sep. 4, 2008 (DE) ..... 10 2008 046 413

(51) Int. Cl.
*B03C 3/00* (2006.01)
*B03C 3/16* (2006.01)
(Continued)

(52) U.S. Cl.
CPC ..... *B05B 15/1244* (2013.01); *B03C 3/025* (2013.01); *B03C 3/08* (2013.01); *B03C 3/68* (2013.01); *Y10S 55/46* (2013.01)
USPC ..... 96/52; 96/75; 55/DIG. 46; 118/326

(58) Field of Classification Search
CPC ..... B03C 3/025; B03C 3/68; B03C 3/08; B03C 3/00; B03C 3/16; B03C 3/38; B03C 3/40; B03C 3/41; B03C 3/74; B03C 3/78; B03C 3/88; B05B 15/1244
USPC ..... 96/43–45, 47, 48, 50, 52, 53, 62, 73, 96/96, 98, 327, 328; 95/64, 65, 71, 75; 55/DIG. 46; 261/112.1; 118/61, 326
See application file for complete search history.

(56) References Cited

U.S. PATENT DOCUMENTS 2,899,183 A * 8/1959 Umbricht et al. ..... 261/24
3,248,857 A * 5/1966 Weindel et al. ..... 96/49
(Continued)

FOREIGN PATENT DOCUMENTS

DE 66 05 251 U1 4/1970
DE 39 00 139 A1 7/1990
(Continued)

*Primary Examiner* — Duane Smith
*Assistant Examiner* — Sonji Turner
(74) *Attorney, Agent, or Firm* — Factor Intellectual Property Law Group, Ltd.

(57) ABSTRACT

A device for separating paint overspray from the cabin exhaust air of painting systems which is laden with overspray having at least one separating surface, on which the cabin exhaust air can be guided along and which is electrically conducting and connected to a pole of a high voltage source. An electrode device arranged in the air stream is associated with the separating surface and connected to the other pole of the high voltage source. Paint overspray is transported away from the separating surface by an electrically conducting separating fluid, which can be fed to the separating surface and flows over the separating surface so that a large part at least of the solids pass from the cabin exhaust air flowing past into the separating fluid.

9 Claims, 7 Drawing Sheets

(51) Int. Cl.

| | |
|---|---|
| ***B05B 15/12*** | (2006.01) |
| ***B03C 3/02*** | (2006.01) |
| ***B03C 3/08*** | (2006.01) |
| ***B03C 3/68*** | (2006.01) |

(56) References Cited

U.S. PATENT DOCUMENTS

| | | | | | |
|---|---|---|---|---|---|
| 3,390,400 | A | * | 6/1968 | Dock | 454/54 |
| 3,504,738 | A | * | 4/1970 | McGuffey, | 165/117 |
| 3,744,217 | A | | 7/1973 | Ebert | |
| 3,785,125 | A | * | 1/1974 | DeSeversky | 96/45 |
| 3,803,997 | A | * | 4/1974 | Van Raden | 454/54 |
| 3,890,103 | A | | 6/1975 | Konishi | |
| 4,189,308 | A | * | 2/1980 | Feldman | 95/75 |
| 4,597,780 | A | * | 7/1986 | Reif | 96/45 |
| 5,264,014 | A | | 11/1993 | Lannefors et al. | |
| 5,476,539 | A | | 12/1995 | Suzuki et al. | |
| 5,626,652 | A | * | 5/1997 | Kohl et al. | 96/45 |
| 5,698,012 | A | | 12/1997 | Yoshikawa | |
| 6,783,575 | B2 | * | 8/2004 | Pasic et al. | 96/44 |
| 2008/0216658 | A1 | * | 9/2008 | Maekawa et al. | 96/44 |
| 2008/0216659 | A1 | * | 9/2008 | Maekawa et al. | 96/44 |

FOREIGN PATENT DOCUMENTS

| | | | | | |
|---|---|---|---|---|---|
| DE | 40 90 626 | T1 | | 4/1992 | |
| DE | 44 13 118 | A1 | | 1/1995 | |
| JP | 53-113374 | A | * | 10/1978 | 96/45 |
| JP | 6-47310 | A | * | 2/1994 | 96/45 |

* cited by examiner

DEVICE FOR SEPARATING PAINT OVERSPRAY

RELATED APPLICATIONS

This application claims the filing benefit of International Patent Application No. PCT/EP2009/006105, filed Aug. 22, 2009, which claims the filing benefit of German Patent Application No. 10 2008 046 413.9 filed Sep. 4, 2008, the contents of which are incorporated herein by reference.

TECHNICAL FIELD

The invention relates to a device for separating paint overspray from the overspray-laden booth exhaust air from paint shops having a) at least one separation surface, along which the booth exhaust air may be guided and which is connected electrically conductively and with one pole of a high voltage source;
b) an electrode apparatus arranged in the air stream which is associated with the separation surface and is connected with the other pole of the high voltage source;
c) means with which the separated paint overspray is conveyed away from the separation surface.

BACKGROUND OF THE INVENTION

On manual or automatic application of paints onto objects, a sub-stream of the paint, which generally contains both solids and solvent and/or binder, is not applied onto the object. In specialist circles, this sub-stream is known as "overspray". The overspray is entrained by the air stream in the spray booth and sent for separation.

In particular in installations with relatively high paint consumption, for example in installations for painting vehicle bodies, wet separation systems are preferably used. In commercially known wet separators, water flows together with the booth exhaust air arriving from above to a nozzle which accelerates air flow. In this nozzle, the through-flowing booth exhaust air is swirled with the water. As this happens, the overspray particles largely pass over into the water, such that the air leaves the wet separator in a substantially purified state and the paint overspray particles are located in the water, from which they may then be recovered or disposed of.

In known wet separators, a relatively large amount of energy is required to circulate the very large quantities of water which are necessary. Treating the rinsing water is costly due to the elevated use of paint-binding and detackifying chemicals and disposal of paint sludge. Furthermore, due to intimate contact with the rinsing water, the air absorbs a great deal of moisture which, when the air is recirculated, in turn results in elevated energy consumption for air treatment.

In contrast, in commercially known devices of the above-mentioned type separation is performed by dry methods in that the paint overspray particles entrained by the booth exhaust air are ionised as they flow past the electrode apparatus and, due to the electric field established between the separation surface and the electrode apparatus, migrate to the separation surface, on which they separate out. The paint overspray particles adhering to the separation surface may then for example be mechanically scraped off therefrom and conveyed away.

Such separators have a very effective cleaning action. However, if operation is to be continuous, constant care must be taken to ensure that a sufficiently strong electric field can form between the separation surface and the electrode apparatus, something which is only possible up to a certain layer thickness of paint overspray on the separation surface, since such a layer has an insulating action. The necessary continuous removal of the paint overspray from the separation surface is, however, associated with very considerable structural complexity and may be susceptible to breakdown.

The present invention is directed to resolving these and other matters.

SUMMARY OF THE INVENTION

An object of the present invention is accordingly to provide a separation device of the above-mentioned type, in which conveying of paint overspray away from the separation surface is improved and simplified.

This object may be achieved in a device of the above-mentioned type in that d) an electrically conductive separation liquid may be supplied to the separation surface, which separation liquid flows over the separation surface, such that a majority of at least the solids passes from the booth exhaust air which is flowing past into the separation liquid and is conveyed away thereby.

The invention thus combines the advantage of good separation of paint overspray from booth exhaust air by means of an electric field with good transport of paint overspray in a liquid.

Thanks to the separation liquid constantly flowing along the separation surface, paint overspray absorbed thereby is continuously conveyed away, such that adhesion of paint overspray to the separation surface is reduced, which adhesion would result in insulation thereof.

It is favourable for the electrode apparatus to comprise a plate-shaped electrode and at least one wire electrode. A wire electrode acts as a discharge electrode, by means of which the paint overspray particles entrained by the booth exhaust air may be effectively ionised. Thanks to the interplay between a plate-shaped electrode and the separation surface, a homogeneous field can be formed, by means of which the ionised paint overspray particles may be reliably directed to the separation surface.

It is here advantageous for the plate-shaped electrode to take the form of a grid electrode. Swirling occurs at the grid which results in a more uniform distribution of the paint overspray particles in the booth exhaust air flowing past the grid, which in turn has a favourable impact on the separation thereof on the separation surface.

The efficiency of ionisation of the paint overspray particles is increased if the electrode apparatus comprises a plurality of wire electrodes which extend parallel to one another.

It is advantageous for a separation unit to be provided which comprises two separation surfaces oriented in different directions. If the separation surfaces of at least one separation unit extend parallel to one another in at least one portion, a plurality of separation units may be arranged in a cascading series, whereby good use is made of the available structural space.

It is in particular favourable for a plurality of separation units to be arranged such that two separation units in each case having one separation surface are opposite one another and an electrode apparatus is in each case arranged between the opposite separation surfaces of two separation units. As a result, a single electrode apparatus interacts with two separation surfaces, so improving the effectiveness of the device.

If the at least one separation surface comprises at least one curved portion which extends along the at least one wire electrode, it is possible to bring about a reduction in the flow velocity of the booth exhaust air in the region of the wire electrode. A volume of the booth exhaust air accordingly spends longer in the region of influence of the wire electrode, such that a larger proportion of paint overspray particles is ionised in this volume. In addition, swirling and turbulence arises in the region of curvature which makes the distribution of paint overspray particles in the booth exhaust air more uniform.

It is here favourable for the number of curved portions of the at least one separation surface to match the number of wire electrodes, such that the stated effects occur in the region of each wire electrode.

Particularly good separation results may be achieved with a device in which the curvature of one or more curved portions extends in cross-section over a circular arc, the centre point of which is concentric to the wire electrode.

Overall, it is advantageous for effective separation for the at least one wire electrode to be arranged such that the overspray-laden booth exhaust air reaches it before the plate-shaped electrode.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
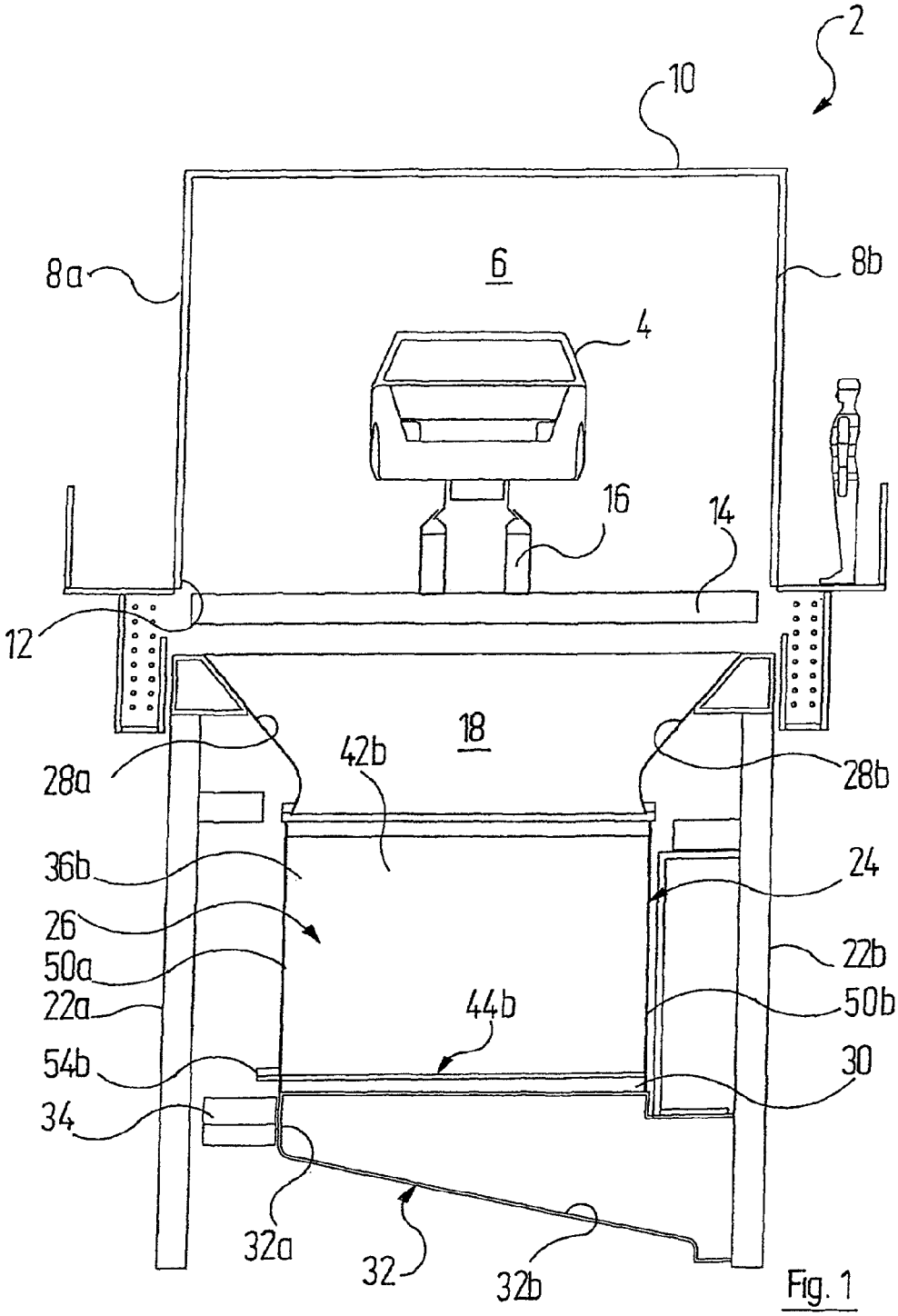
FIG. 1 is a front view of a painting booth of a surface treatment installation with a first exemplary embodiment of an overspray separation device.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
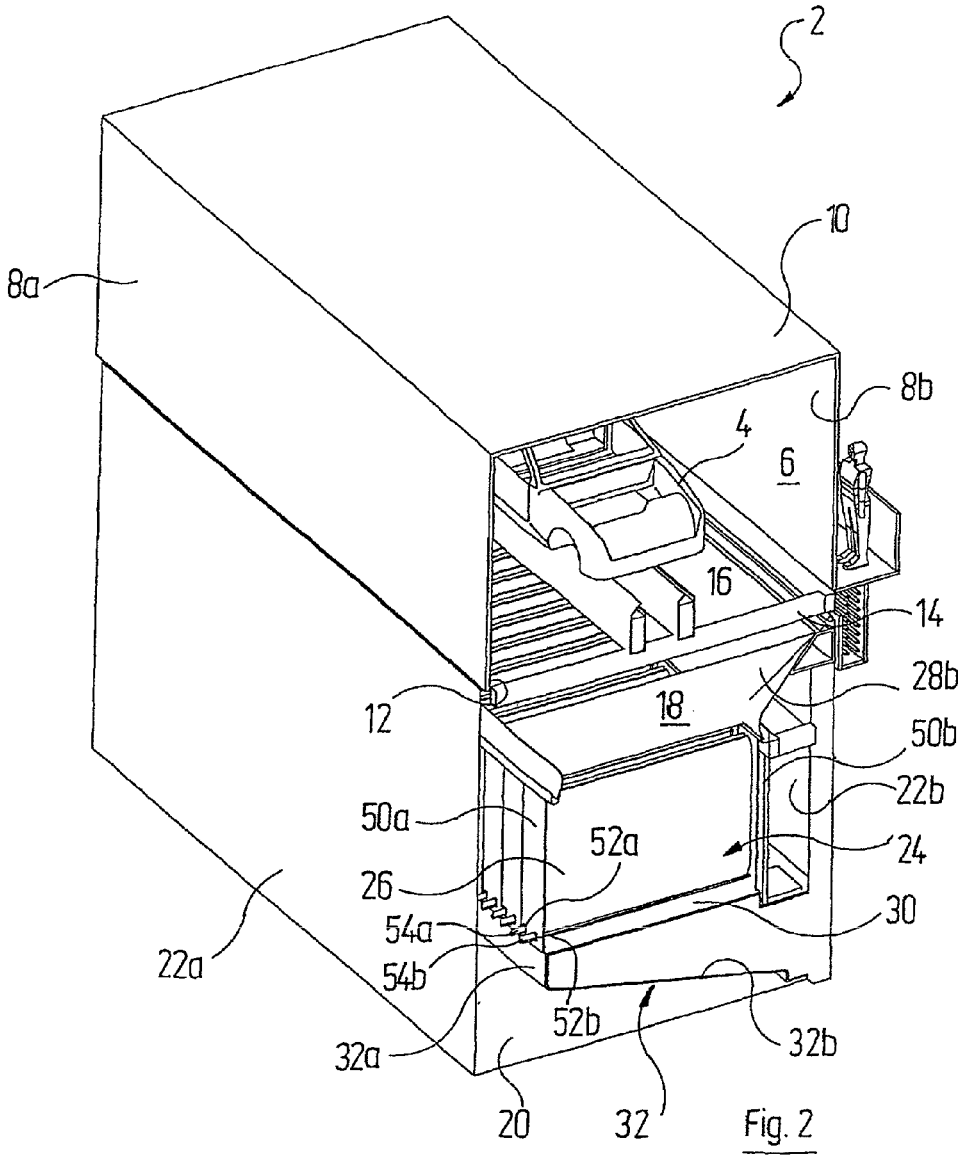
FIG. 2 is the painting booth of FIG. 1 in perspective view.

Reference will be made first of all to FIGS. 1 and 2. A painting booth of a surface treatment installation is here denoted overall 2, in which vehicle bodies 4 are painted once they have, for example, been cleaned and degreased in pretreatment stations, not separately shown, upstream of the painting booth 2.

The painting booth 2 comprises a painting tunnel 6 arranged on top, which is bounded by vertical side walls 8*a*, 8*b* and a horizontal booth ceiling 10, but is open at the end faces and downwards in such a manner that overspray-laden booth exhaust air can flow downwards. The booth ceiling 10 is configured in conventional manner as the lower boundary of the air feed chamber (not shown) with a filter ceiling.

A steel construction 14 is arranged at the level of the lower opening 12 of the painting tunnel 6 flanked by the lower edges of the side walls 8*a*, 8*b*, which construction carries a per se known conveying system 16, which is not described in greater detail here. The latter is capable of conveying vehicle bodies 4 to be painted from the input side of the painting tunnel 6 to its output side. In the interior of the painting tunnel 6 are located application devices (not separately shown), by means of which the vehicle bodies 4 may be coated with paint in a manner known per se.

Below the lower opening 12 of the painting tunnel 6, there is a separation chamber 18 open at the top towards the painting tunnel 6, in which chamber paint overspray arising during the painting process is separated.

The separation chamber 18 is bounded by a base plate 20 visible in FIG. 2, two vertical side walls 22*a*, 22*b* and two vertical end walls, the latter two being omitted from FIGS. 1 and 2.

In the separation chamber 18 there is arranged a separation device 24 having a plurality of separation units 26 arranged in series in the longitudinal direction of the separation chamber 18, which will be described in greater detail below.

In the region of the separation chamber 18 between the separation device 24 and the painting tunnel 6 are located two air baffle plates 28*a*, 28*b*, which, starting from the side walls 22*a*, 22*b* of the separation chamber 18, initially converge downwards and, in the end region thereof facing the separation device 24, diverge towards the lateral boundaries of the separation device 24. The air baffle plates 28*a*, 28*b* and corresponding air baffle plates (not shown) at the end faces extend from above down to the separation device 24.

The separation units 26 rest on a mounting frame 30, which allows air to flow downwards out of the separation device 24. Below the separation device 24 is located a further air baffle plate 32, which extends along the separation device 24 in the separation chamber 18. The air baffle plate 32 comprises a vertical portion 32*a*, which faces the left-hand side wall 22*a* in FIGS. 1 and 2 of the separation chamber 18, and a portion 32*b* which extends obliquely downwards towards the opposite side wall 22*b* of the separation chamber 18.

Between the vertical portion 32*a* of the air baffle plate 32 and the left-hand side wall 22*a* in FIGS. 1 and 2 of the separation chamber 18, there is arranged a collecting channel 34, shown only schematically in FIG. 1, which extends parallel to the vertical portion 32*a* of the air baffle plate 32 and which is inclined in the longitudinal direction relative to a horizontal plane.

Figure 3:
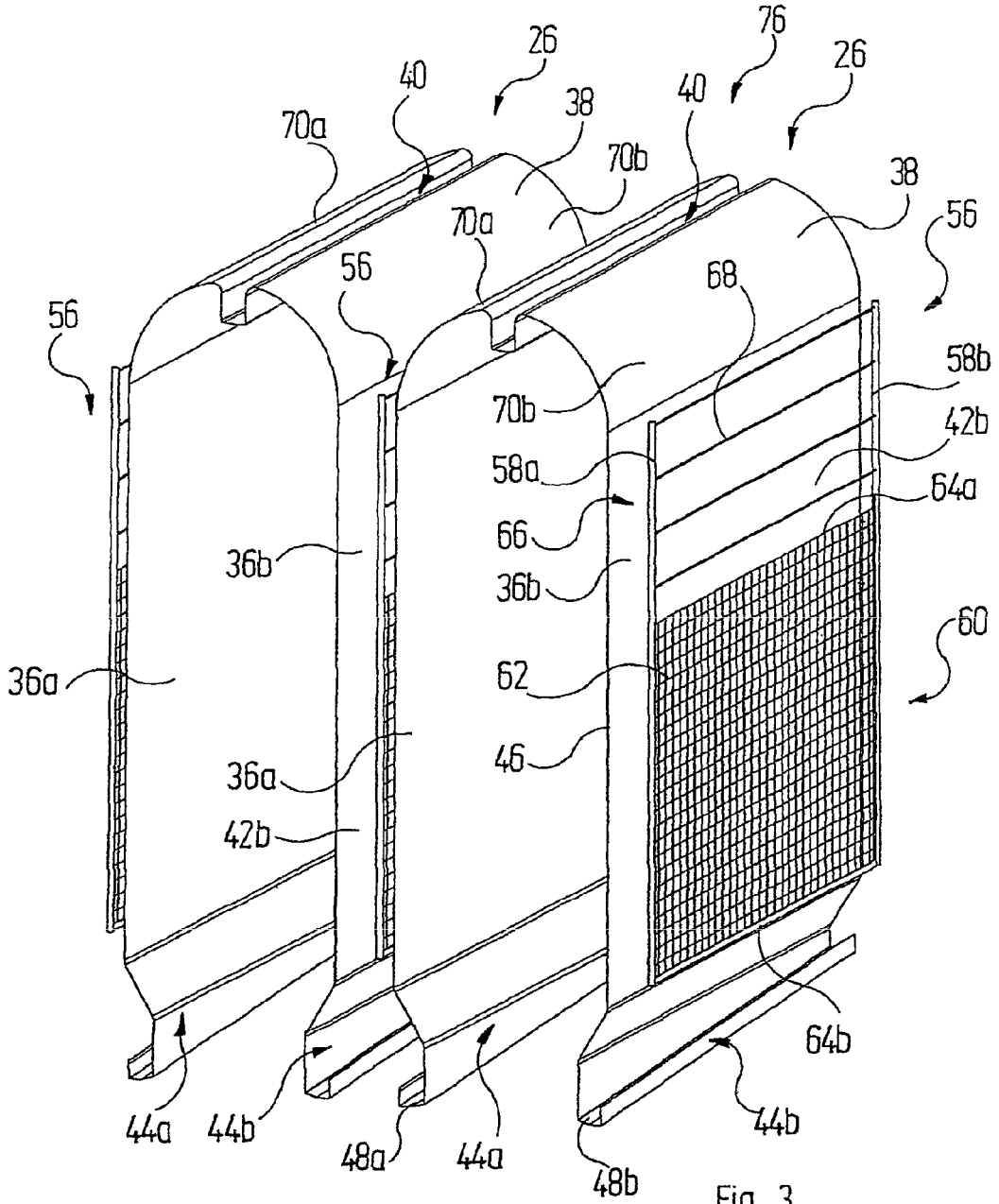
FIG. 3 is a perspective view of two separation units and three electrode apparatuses of the separation device of FIG. 1.
Figure 4:
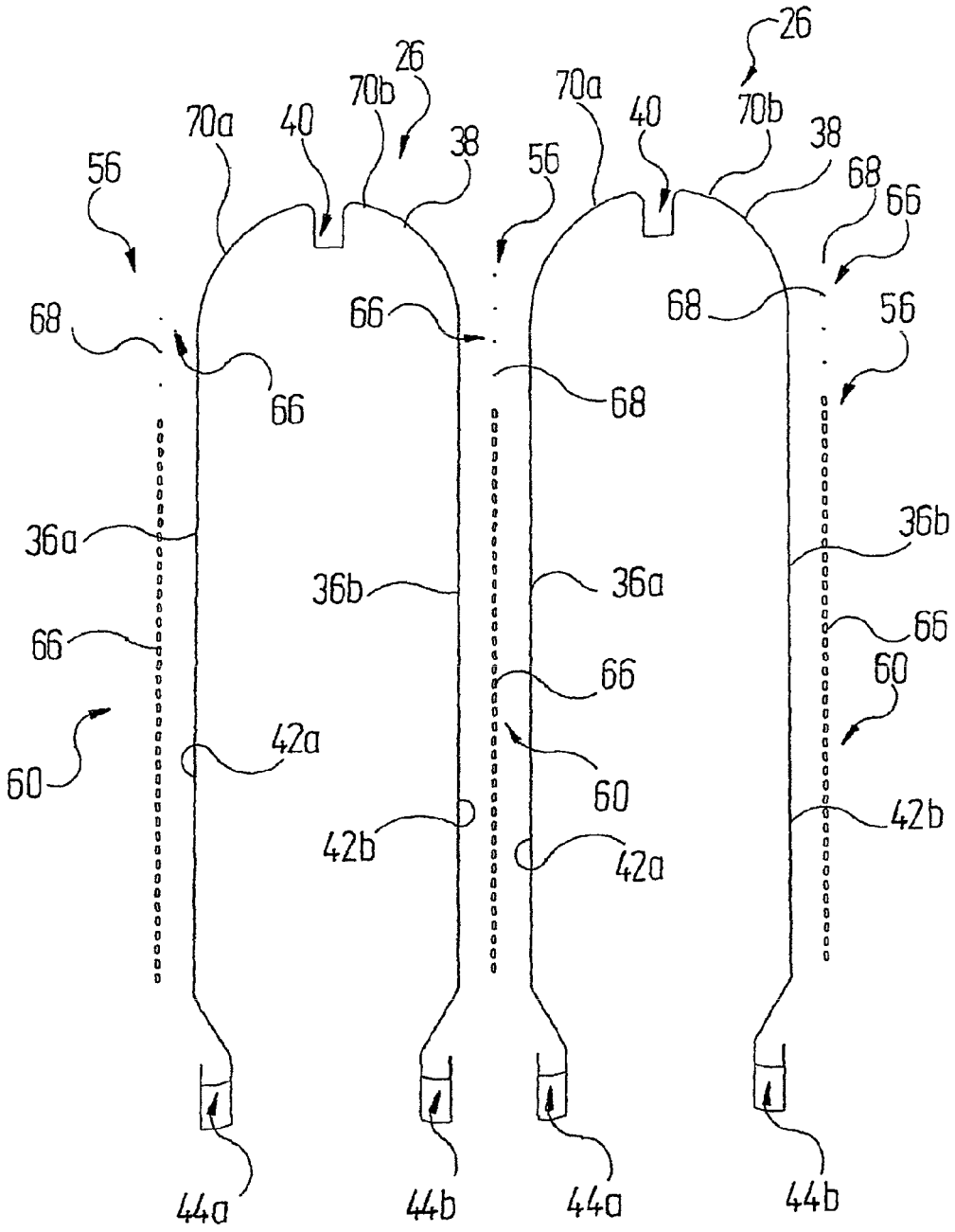
FIG. 4 is a vertical section through the two separation units with electrode apparatuses of FIG. 3.

FIGS. 3 and 4 show are two adjacent separation units 26 of the separation device 24. As may be seen therein, a separation unit 26 comprises two mutually spaced parallel rectangular side plates 36*a*, 36*b* which are joined together at their upper opposite end edges via a curved portion 38, the overall outer contour of which is semicircular in cross-section and forms the top of the separation unit 26.

An overflow channel 40, which will be described in greater detail below, is provided at the vertex of the curved portion 38 of the separation units 26.

The respective outer faces of the side plates 36*a*, 36*b* form separation surfaces 42*a* or 42*b*, which will likewise be described again further below.

At their lower edges, the side plates 36*a*, 36*b* in each case bear an outlet channel 44*a*, 44*b*, which extends parallel to the side plates 36*a*, 36*b* of the separation units 26 and is inclined downwards towards a first end face 46, at the front in FIG. 3, of the separation unit 26. The outlet channels 44*a*, 44*b* terminate at their end faces with the side plates 36*a*, 36*b* of the separation unit 26 (cf. FIG. 3). The outlet channels 44*a*, 44*b* are open at their respective ends 48*a* and 48*b* at the first end face 46 (cf. FIG. 3) of the separation unit 26.

As may be seen in FIGS. 1 and 2, each separation unit 26 comprises a first end wall 50*a* which is arranged at the first end face 46 thereof. The opposite end face of the separation units 26, which is not provided with a separate reference numeral, is covered by a second end wall 50*b*. The end walls 50*a*, 50*b* of the separation units 26 close the end faces of the associated overflow channel 40. The two end walls 50*a*, 50*b* are made of plastics. The first end wall 50*a* of the separation unit 26 comprises two openings 52*a*, 52*b*, into which in each case opens an outlet channel 44*a*, 44*b* with the ends 48*a*, 48*b* thereof. Drip plates 54*a*, 54*b* are positioned at the openings 52*a*, 52*b* on the opposite side of each end wall 50*a* to the outlet channels 44*a*, 44*b*. Said drip plates take the form of a profile, the cross-section of which corresponds to that of the outlet channels 44*a*, 44*b*.

If the separation device 24 is arranged in the separation chamber 18 of the painting booth 2, the drip plates 54*a*, 54*b* of each separation unit 26 project over the collecting channel 34.

Two adjacent separation units 26 are arranged, while maintaining mutual spacing, in the separation device 24, Between two adjacent separation units 26 and at the free side plates 36*a* or 36*b* of the two outermost separation units 26 within the separation device 24, there extends in each case an electrode apparatus 56, each of which is connected with a high voltage source which is not shown separately in FIG. 4. In a variant, the electrode apparatuses 56 may also be supplied by a single high voltage source. The separation units 26 are at earth potential.

Each electrode apparatus 56 comprises two straight electrode rails 58*a*, 58*b* which extend parallel to one another. In a field portion 60 of the electrode apparatus 56, these hold a grid electrode 62, whose edges 64*a*, 64*b*, which extend between the electrode rails 58*a*, 58*b*, are perpendicular to the latter. In a corona portion 66 of the electrode apparatus 56, the electrode rails 58*a*, 58*b* hold a plurality of corona wires 68 acting as a discharge electrode. The corona wires 68 extend in a plane defined by the electrode rails 58*a*, 58*b* parallel to the edges 64*a*, 64*b* of the grid electrode 62 and are identically spaced apart from one another.

As may be seen in FIGS. 3 and 4, the electrode apparatuses 56 have an overall extent which substantially corresponds to the extent of the side plates 36*a*, 36*b* of the separation units 26. The electrode apparatuses 56 are arranged such that the lower edge 64*b* of the grid electrode 62 is arranged roughly at the height of the lower end of the side plates 36*a* or 36*b*.

When the separation device 24 is in operation, a separation liquid flows on the respective separation surface 42*a*, 42*b* of the side plates 36*a*, 36*b* of the separation units 26 from the top downwards into the outlet channels 44*a*, 44*b*, which separation liquid is suitable for absorbing solid particles from the paint overspray arising during the painting process.

To this end, said separation liquid is supplied to the overflow channel 40 in the curved portion 38 of the separation units 26. The separation liquid passes from there over the curved flanks 70*a*, 70*b*, which are adjacent to the overflow channel 40, of the curved portion 38 of the separation unit 26 in each case as a continuous film to the side plates 36*a*, 36*b* and flows down over the separation surfaces 42*a*, 42*b* thereof, still as a continuous film of separation liquid.

The number of corona wires 68 of the electrode apparatus 56 and their spacing from one another may vary as a function of the separation behaviour of the overspray particles. In the present exemplary embodiment, four corona wires 68 are provided, the uppermost of which is arranged next to the curved portion 38 of the separation unit 26, while the corona wire 68 located therebelow is still located in the region next to the respective side plate 36*a* or 36*b* of the separation unit 26.

Figure 5:
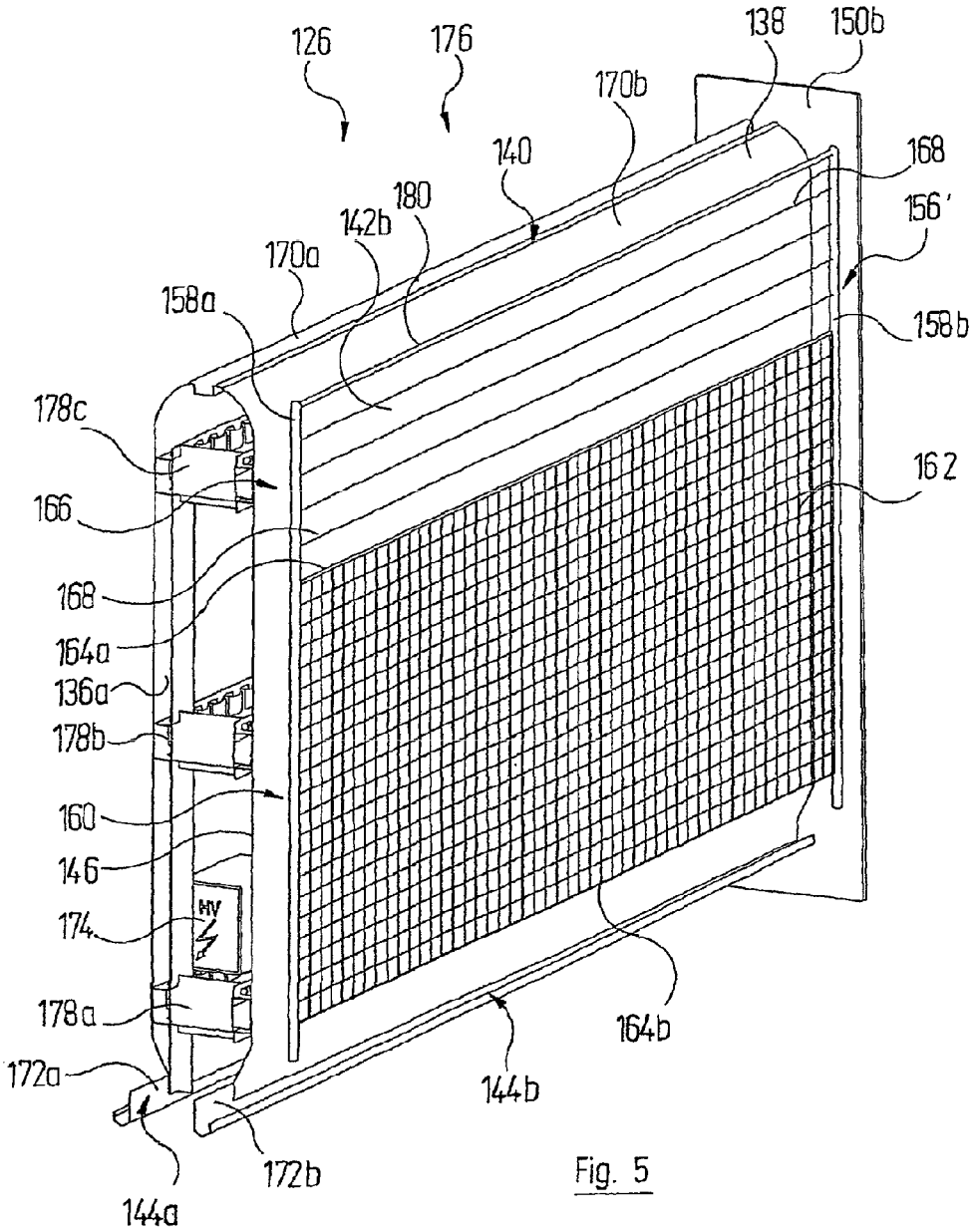
FIG. 5 is a perspective view of two separation units and three electrode apparatuses in each case according to a second exemplary embodiment.
Figure 6:
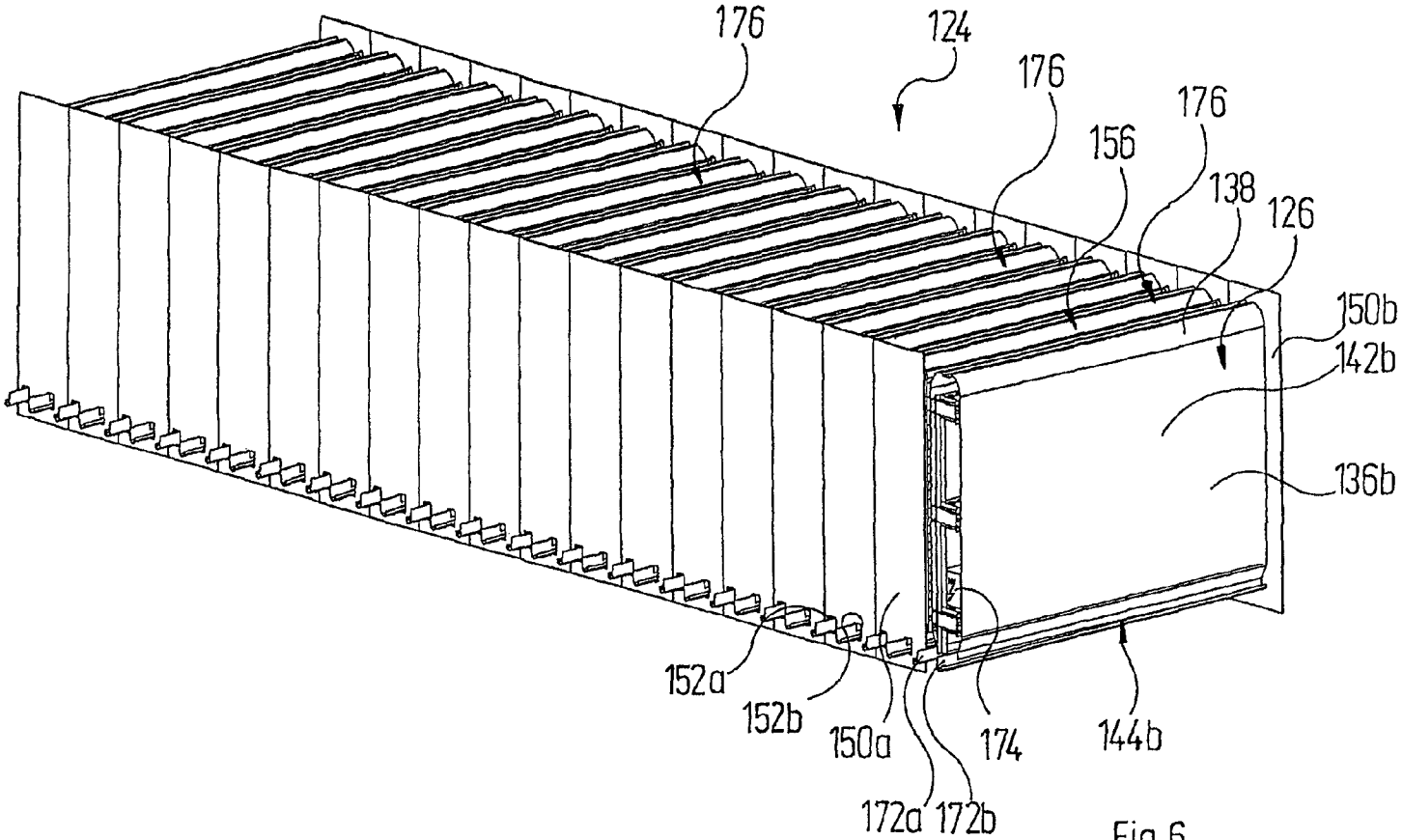
FIG. 6 is a perspective view of a second exemplary embodiment of an overspray separation device which comprises a plurality of separation units and electrode apparatuses according to FIG. 5.

FIG. 5 shows, in each case as a second exemplary embodiment, a modified separation unit 126 together with a modified electrode apparatus 156 while FIG. 6 shows a modified separation device 124 comprising these. Components of the separation unit 126, the electrode apparatus 156 and the separation device 124 which correspond to those of the separation unit 26, the electrode apparatus 56 and the separation device 24 according to FIGS. 1 to 4, are designated with the same reference numerals plus 100.

The separation unit 126 differs from the separation unit 26 inter alia in that the outlet channels 144*a*, 144*b* project beyond the end face 146 of the separation unit 126. The projecting portions 172*a*, 172*b* correspond to the drip plates 54*a*, 54*b* described above, which may therefore be omitted from the separation device 124.

As may be seen in FIG. 6, the projecting portions 172*a*, 172*b* of the outlet channels 144*a*, 144*b* of the separation unit 126 extend through the respective openings 152*a*, 152*b* in each end wall 150*a* of the separation device 124.

FIG. 5 shows a high voltage source 174 which is arranged between the side plates 136*a*, 136*b* of each separation unit 126 and is connected with the electrode apparatus 156. The high voltage source 174 may correspondingly also be present in each separation unit 26 in accordance with the first exemplary embodiment. In each case, an individual separation unit 126 and an individual electrode apparatus 156 thus form a separation module 176. Correspondingly, an individual separation unit 26 and an individual electrode apparatus 56 according to FIGS. 1 to 4 in each case also form a separation module 76.

FIG. 5 moreover shows bracing elements 178*a*, 178*b*, 178*c*, which connect the inner faces of the two side plates 136*a*, 136*b* of the separation unit 126 with one another at the bottom, in the middle and at the top.

In the electrode apparatus 156 according to the second exemplary embodiment, a protective bar 180 extends perpendicularly between the electrode rails 158*a*, 158*b* above the uppermost corona wire 168, which protective bar reduces the risk of any objects or particles which may fall down from the painting tunnel 6 onto the electrode apparatus 156 from coming into contact with the corona wires 168.

Otherwise, the above statements regarding the separation unit 26, the electrode apparatus 56 and the separation device 24 apply mutatis mutandis to the separation unit 126, the electrode apparatus 156 and the separation device 124.

The basic principle of the devices explained above will now be explained using the separation device 24 according to FIGS. 1 to 4 by way of example. The separation device 124 according to FIGS. 5 and 6 is used in a similar manner in the painting booth 2.

When vehicle bodies are painted in the painting tunnel 6, the booth air located therein becomes laden with paint overspray particles. These may be still liquid and/or tacky but also already more or less solid. The booth exhaust air laden with paint overspray flows through the lower opening 12 of the painting tunnel 6 into the separation chamber 18. Here, said air is guided by the air baffle plates 28*a*, 28*b* towards the separation device 24 and flows between adjacent separation units 26 towards the lower air baffle plate 32.

Corona discharges occur in a manner known per se at the corona wires 68, and such discharges effectively ionise the overspray particles in the booth exhaust air as it flows past.

The ionised overspray particle pass by the side plates 36*a*, 36*b*, which are at earth potential, of two adjacent separation units 26 and the grid electrode 62 extending therebetween in the first portion 60 of the electrode apparatus 56. Due to the electrical field formed between the grid electrode 62 and side plates 32*a*, 32*b*, the ionised overspray particles separate out onto separation surfaces 42*a*, 42*b* of the side plates 36*a*, 36*b* of the separation units 26, where they are absorbed by the separation liquid flowing thereover.

Some of the ionised overspray particles separate out onto the separation units 26 as early as in the second portion 66 of the electrode apparatus 56 in the region of the corona wires 68. However, the electrical field present between the corona wires 68 and the respective side plate 36*a*, 36*b* of the separation unit 26 is more non-homogeneous than the electrical field in the region of the grid electrode 62, for which reason more directed and more effective separation of the ionised overspray particles occurs here on the corresponding separation unit 26.

The air purified on passing between the separation units 26 is guided by the lower air baffle plate 32 towards the side wall 22*b*, shown on the right-hand side in FIGS. 1 and 2, of the separation chamber 18, from where, optionally after a certain degree of conditioning, it may be resupplied to the painting tunnel 6 as fresh air. Conditioning may in particular involve a readjustment of temperature or atmospheric humidity and optionally removal of solvents still present in the air.

The separation liquid flowing down over the separation units 26 which is now laden with the overspray particles passes at the bottom into the outlet channels 44*a*, 44*b* of the separation units 26. Due to the inclination of the outlet channels 44*a*, 44*b*, the laden separation liquid flows towards the openings 52*a*, 52*b* in the respective end walls 50*a*, through the latter and thence via the drip plates 54*a*, 54*b* into the collecting channel 34. The separation liquid laden with overspray particles flows via the collecting channel 34 out of the painting booth 2 and may be sent for purification and reprocessing, in which the overspray particles are removed from the separation liquid, or for disposal.

Figure 7:
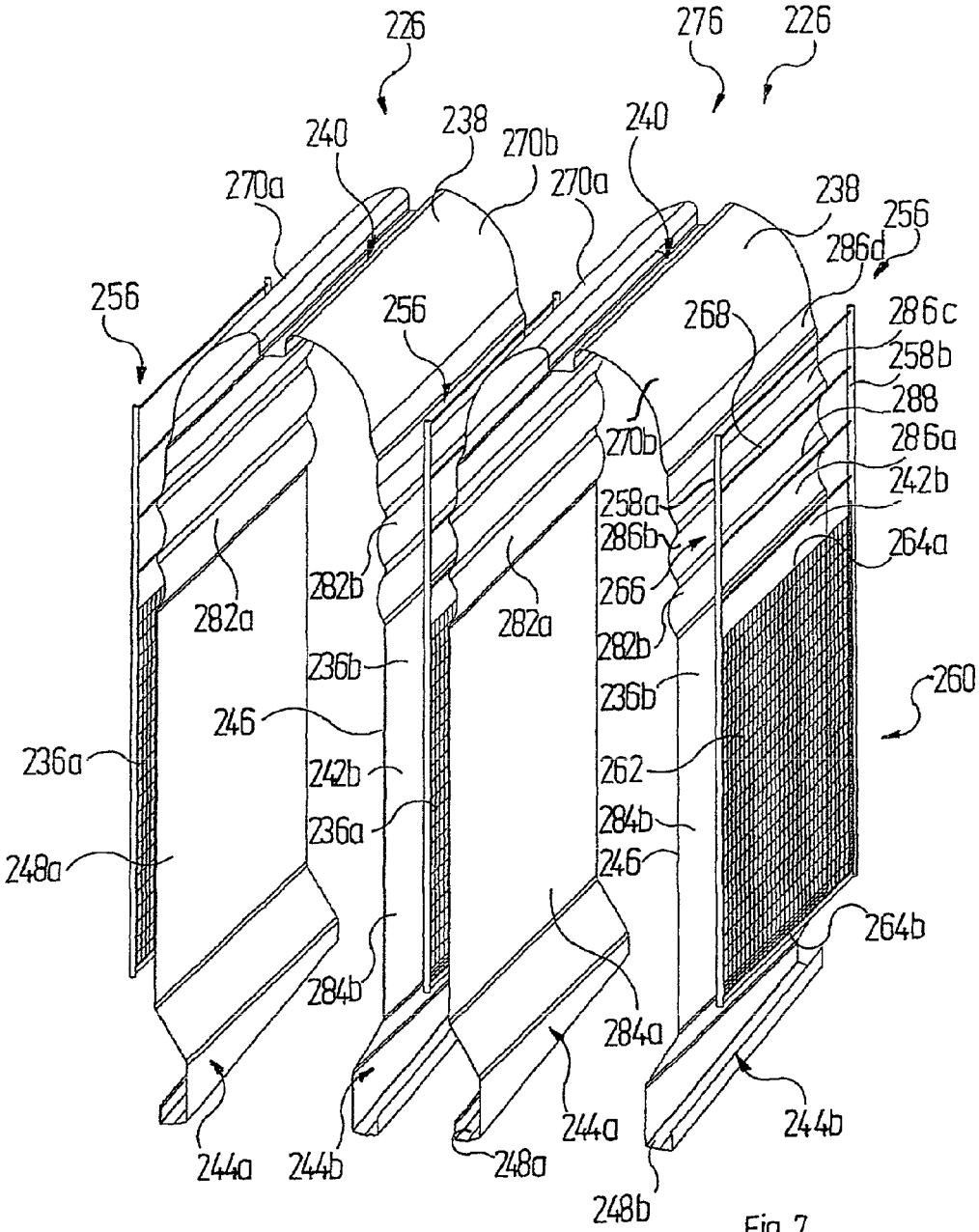
FIG. 7 is a perspective view of two separation units according to a third exemplary embodiment and three electrode apparatuses according to the first exemplary embodiment according to FIG. 3.

FIG. 7 shows two further modified separation units 226 according to a third exemplary embodiment. Components of the separation unit 226 which correspond to those of the separation unit 26 according to FIGS. 1 to 4 are designated with the same reference numerals plus 200. In addition, three electrode apparatuses 256 may be seen in FIG. 7, which correspond to the electrode apparatuses 156 according to FIGS. 3 and 4. A separation unit 226 and an electrode unit 256 in each case form a module 276.

In the separation unit 226, the side plates 236*a*, 236*b* have corrugated portions 282*a*, 282*b*, which adjoin the respective flanks 270*a*, 270*b* of the curved portion 238 of the separation unit 226. Between the outlet channels 244*a*, 244*b* and the corrugated portions 282*a*, 282*b*, the respective side plate 236*a*, 236*b* comprises a planar portion 284*a*, 284*b*.

Each corrugated portion 282*a*, 282*b* has, in each case relative to the central plane, which extends between and parallel to the planar portions 284*a*, 284*b*, of the separation unit 226, inwardly curved portions 286*a*, 286*b*, 286*c*, 286*d* as well as outwardly curved portions 288, which in each case extend along a corona wire 268. The number of inwardly curved portions 286 of each corrugated portion 282*a*, 282*b* of the side plates 236*a*, 236*b* thus corresponds to the number of corona wires 268 of the electrode apparatus 256.

For clarity's sake, in each case only one of the inwardly curved portions 286*a*, 286*b*, 286*c* and 286*d* and only one of the outwardly curved portions 288 is provided with a reference numeral.

The curvature of the two lower and of the uppermost inwardly curved portions 286*a*, 286*b* and 286*d* follows a circular arc when viewed in cross-section. The inwardly curved portions 286*a*, 286*b* and 286*d* are in each case arranged relative to an adjacent corona wire 268 such that the latter is concentric in cross-section to the circular arc defining by the profile of the respective curved portion 286*a*, 286*b* or 286*d*. The uppermost inwardly curved region 86*d* is somewhat shorter in the vertical direction than the lower two inwardly curved regions 286*a* and 286*b*.

In the inwardly curved portion 286*c* arranged below the uppermost curved portion 286*d*, the radius of curvature declines from the bottom upwards, such that, when viewed in cross-section, the inwardly curved portion 286*c* has a parabola-like profile. As a result, the spacing between the outside ends of opposite flanks 270*a*, 270*b* of two adjacent separation units 226 is smaller in a horizontal plane than the spacing between their opposite planar portions 284*a*, 284*b* of the respective side plates 236*a*, 236*b*.

The spacing of two adjacent separation units 226 with electrode apparatus 256 arranged therebetween is adjusted such that the corona wires 268, when viewed in cross-section, are in each case concentric to the centre point of the approximately cross-sectionally circular arc-shaped segments defined by two opposite, inwardly curved portions 286*a*, 286*b* or 286*d*.

Due to the inwardly curved portions 286 of the corrugated portions 282*a*, 282*b* of the separation units 226, the channel formed there between the separation units 226, through which channel the overspray-laden booth exhaust air flows, is in each case locally widened at that point. As a result, at the level of the inwardly curved regions 286 of the side plates 236*a*, 236*b*, there is in each case a reduction in flow velocity, whereby the booth exhaust air flowing past the respective corona wire 268 remains for longer in its region of influence. As result, a greater proportion of overspray in a given volume of booth exhaust air is in turn ionised by the corona wire 268 in question. Thanks to the inwardly curved portions 286, which are arranged in series in the direction of flow of the booth exhaust air, of the side plates 236*a*, 236*b* of the separation units 226, a significantly larger proportion of overspray is ionised in the second electrode portion 266 with the corona wires 268 than would be the case with continuously planar side plates 236*a*, 236*b* at an identical flow velocity of the booth exhaust air. For this reason it is possible to achieve an overall increase in the throughput of booth exhaust air, since the flow velocity of the overspray-laden booth exhaust air may be raised in such a manner that its residence time in the region of the corona wires 268 corresponds to the residence time at a lower flow velocity and with completely planar side plates 236*a*, 236*b*.

Flow velocity may, for example, be increased by a factor of 4 to 6. If, for example, in a separation apparatus 24 with separation units 26 according to the first exemplary embodiment, a flow velocity of the booth exhaust air laden with overspray particles of 0.25 m/s is possible while satisfactory separation performance is still achievable, then if the separation units 226 are used, the flow velocity of the booth exhaust air may be raised to 1 m/s to 1.5 m/s while nevertheless achieving adequate separation results. If the flow velocity is to be increased, the height of the separation apparatuses may be correspondingly increased to achieve the same separation action.

In addition, swirling and turbulence occurs in the region of the corrugated portions 232*a*, 232*b* of opposite side plates 236*a*, 236*b* of two adjacent separation units 226, whereby the paint overspray particles entrained by the booth exhaust air are uniformly distributed in the region of the corona wires 268 and may thus be more effectively ionised.

In a modification of the electrode apparatuses 56 or 156, which is not shown here in either case, a plate electrode is provided instead of the grid electrode 62 or 162. However, separation of ionised paint overspray particles from the booth exhaust air proceeds more effectively in the presence of the grid electrode 62 or 162, since slight swirling of the booth exhaust air is produced on the grid or grid rods thereof and the ionised paint overspray particles are consequently more homogeneously distributed in the region of the grid electrode 62 or 162 than is the case with a plate electrode with a continuous electrode surface.

In order to reduce any adhesion to the separation surfaces 242*a*, 242*b* which may still occur of separated paint overspray particles which have been absorbed by the separation liquid on the separation surfaces 242*a*, 242*b* of the separation units 226, the separation surfaces 242*a*, 242*b* of each separation unit 226 may be coated with a non-stick coating, such as for example Teflon.

Instead of the overflow channel, from which separation liquid passes over the outer edges thereof and over the curved flanks 70*a*, 70*b*, 170*a*, 170*b* or 270*a*, 270*b* of the curved portion 38, 138 or 238 of the separation units 26, 126 or 226 to the side plates 36*a*, 36*b*, 136*a*, 136*b* or 236*a*, 236*b*, it is also possible to provide separation units 26, 126, 226 with an alternative apparatus with which separation liquid may be applied onto the separation units 26, 126, 226. For example, a sprinkler apparatus, a slot nozzle or simply a tube with orifices may be arranged for this purpose above the curved portion 38, 138 or 238.

It is important for the purposes of interplay with the electrode apparatus 56, 156, 256 and the side plates 36*a*, 36*b*, 136*a*, 136*b*, 236*a*, 236*b* at earth potential of the separation units 26, 126, 226 that the separation liquid be electrically conductive. The separation liquid may be based, for example, on water or on an oil and be provided with additives which assist clumping and/or curing and/or detackifying of paint overspray particles in the separation liquid.

The conductivity of the separation liquid is preferably in the range from 50 to 5000 μS/cm, in particular from 1000 to 3000 μS/cm, and may be adjusted by means of additives, such as for example salts.

Thanks to the above described combination of electrical separation of paint overspray from booth exhaust air laden therewith with the use of the separation liquid for absorbing and conveying away the paint overspray particles, it is possible to achieve efficient and effective purification of overspray-laden booth exhaust air. The purified booth exhaust air may then be resupplied in a circuit to the spray booth as has already been explained above.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A device for separating paint overspray from the overspray-laden booth exhaust air from paintshops having a) at least one separation surface, along which a booth exhaust air may be guided and which is connected electrically conductively with one pole of a high voltage source;

b) an electrode apparatus arranged in the exhaust air which is associated with the separation surface and is connected with another pole of the high voltage source;

c) means with which a separated paint overspray is conveyed away from the separation surface, wherein d) an electrically conductive separation liquid may be supplied to the separation surface, which separation liquid flows over the separation surface, such that a majority of at least solids passes from the booth exhaust air which is flowing past into the separation liquid and is conveyed away thereby;

e) a plurality of separation units, each separation unit comprising two separation surfaces oriented in different directions, wherein a plurality of separation units are arranged such that two separation units in each case having one separation surface are opposite one another, and an electrode apparatus is in each case arranged between the opposite separation surfaces of two separation units, further wherein the separation surfaces are planar, and the separation liquid flows over the separation surface from an overflow channel formed on top of the device.

2. The device of claim 1, wherein the electrode apparatus comprises a plate-shaped electrode and at least one wire electrode.

3. The device of claim 2, wherein the plate-shaped electrode takes the form of a grid electrode.

4. The device of claim 2, wherein the electrode apparatus comprises a plurality of wire electrodes which extend parallel to one another.

5. The device of claim 1, wherein the separation surfaces of the at least one separation unit extend parallel to one another in at least in one portion.

6. The device of claim 2, wherein at least one separation surface comprises at least one curved portion which extends along the at least one wire electrode.

7. The device of claim 6, wherein a number of curved portions of the at least one separation surface matches a number of wire electrodes.

8. The device of claim 6, wherein a curvature of one or more curved portions extends in cross-section over a circular arc, a centre point of which is concentric to the wire electrode.

9. The device of claim 2, wherein the at least one wire electrode is arranged such that the booth exhaust air reaches it before the plate-shaped electrode.

* * * * *